US012503787B2

(12) United States Patent
Gao

(10) Patent No.: US 12,503,787 B2
(45) Date of Patent: Dec. 23, 2025

(54) METHOD AND SYSTEM FOR IMPROVING UNIFORMITY OF PLATING FILM ON WAFER

(71) Applicant: CHANGXIN MEMORY TECHNOLOGIES, INC., Hefei (CN)

(72) Inventor: Yulong Gao, Hefei (CN)

(73) Assignee: CHANGXIN MEMORY TECHNOLOGIES, INC., Hefei (CN)

( * ) Notice: Subject to any disclaimer, the term of this patent is extended or adjusted under 35 U.S.C. 154(b) by 864 days.

(21) Appl. No.: 17/718,571

(22) Filed: Apr. 12, 2022

(65) Prior Publication Data

US 2023/0220581 A1 Jul. 13, 2023

(30) Foreign Application Priority Data

Jan. 13, 2022 (CN) ..... 202210039033.1

(51) Int. Cl.

| | |
|---|---|
| ***C25D 21/12*** | (2006.01) |
| ***C25D 7/12*** | (2006.01) |
| ***C25D 17/00*** | (2006.01) |
| ***C25D 21/08*** | (2006.01) |

(52) U.S. Cl.
CPC ..... *C25D 21/12* (2013.01); *C25D 17/001* (2013.01); *C25D 21/08* (2013.01); *C25D 7/12* (2013.01)

(58) Field of Classification Search
CPC ..... C25D 7/12–123; C25D 17/001; C25D 21/08; H01L 21/2885; H01L 21/76873; H01L 2224/11462
See application file for complete search history.

(56) References Cited

FOREIGN PATENT DOCUMENTS

CN 104195575 A 12/2014

*Primary Examiner* — Hosung Chung
(74) *Attorney, Agent, or Firm* — Kilpatrick Townsend & Stockton LLP

(57) ABSTRACT

A method and system for improving uniformity of plating film on the wafer are provided. The method includes: providing a plating device; providing a wafer, the plating device being configured to coat the wafer; monitoring currents at different areas of a surface of the wafer in a plating process; when a difference between the currents at the different areas of the surface of the wafer is greater than a preset difference, inspecting the plating device; and when an attachment is present on the plating device, cleaning the plating device.

11 Claims, 7 Drawing Sheets

METHOD AND SYSTEM FOR IMPROVING UNIFORMITY OF PLATING FILM ON WAFER

CROSS-REFERENCE TO RELATED APPLICATION

The present application claims benefit of Chinese Patent Application No. 202210039033.1, filed on Jan. 13, 2022, the contents of which are hereby incorporated by reference in their entirety.

TECHNICAL FIELD

This disclosure relates to the field of semiconductor manufacturing, and in particular to a method and system for improving uniformity of plating film on a wafer.

BACKGROUND

For electroplating a surface of a wafer, the wafer is generally soaked in an electrolytic cell solution which contains an ionic solution allowing current to flow from a metal rod (anode) to the wafer (cathode). The current causes the metal to be ionized and conducted to the surface of the wafer through an electroplating device, thereby forming a thin and solid metal film on the surface of the wafer.

Due to continuous improvement of the process, the metal film plated on the edge of the wafer becomes thinner and thinner. If there is metal residue in an area where the electroplating device is in contact with the surface of the wafer, the current conducted to the surface of the wafer will be inconsistent, so that the edge of the wafer will not be plated with the film or the plated film is thinner, thereby affecting the process and resulting in scrapping of the wafer.

Therefore, the technical problem to be solved is to improve uniformity of plating film on the wafer.

SUMMARY

This disclosure provides a method for improving uniformity of plating film on the wafer. The method includes the following operations. A plating device configured to plate a wafer is provided; the wafer is provided and a plating process is performed on the wafer by the plating device; currents at different areas of a surface of the wafer are monitored in a plating process to determine whether a difference between the currents at the different areas of the surface of the wafer is greater than a preset difference; responsive to the difference between the currents at the different areas of the surface of the wafer being greater than the preset difference, a check-up operation is performed on the plating device to detect whether an unwanted attachment is present on the plating device; and responsive to detecting that an unwanted attachment is present on the plating device, a cleaning operation is performed on the plating device.

This disclosure further provides a system for improving uniformity of plating film on the wafer, including: a plating device; a wafer, the plating device being configured to plate the wafer; a detection assembly, configured to monitor currents at different areas of a surface of the wafer in a plating process; a determination assembly, configured to perform a check-up operation on the plating device responsive to a difference between the currents at the different areas of the surface of the wafer being greater than a preset difference; and a cleaning assembly, configured to perform a cleaning operation on the plating device responsive to detecting that an unwanted attachment is present on the plating device.

It should be understood that the foregoing general description and the following detailed description are merely exemplary and explanatory and are not intended to limit this disclosure. Technologies, methods and devices known to persons skilled in art in the related art may not be discussed in detail, but such technologies, methods and devices should be considered as a part of the specification in appropriate situations.

BRIEF DESCRIPTION OF THE DRAWINGS

To describe the technical solutions in embodiments of this disclosure more clearly, the accompanying drawings for the embodiments of this disclosure are briefly introduced below. Apparently, the accompanying drawings in the following description show merely some embodiments of this disclosure, and persons skilled in the art can still derive other drawings from these accompanying drawings without creative efforts.

DETAILED DESCRIPTION

The specific implementations of a method for improving uniformity of plating film on the wafer provided by this disclosure are described in detail below with reference to the accompanying drawings. The following descriptions of at least one exemplary embodiment are merely illustrative actually, and are not intended to limit this disclosure and the applications or uses thereof. That is to say, persons skilled in the art will understand that they are merely illustrative of exemplary implementations of this disclosure but not exhaustive. Unless otherwise stated specifically, relative arrangement of the components and steps set forth in the embodiments are not intended to limit the scope of this disclosure.

Figure 1:
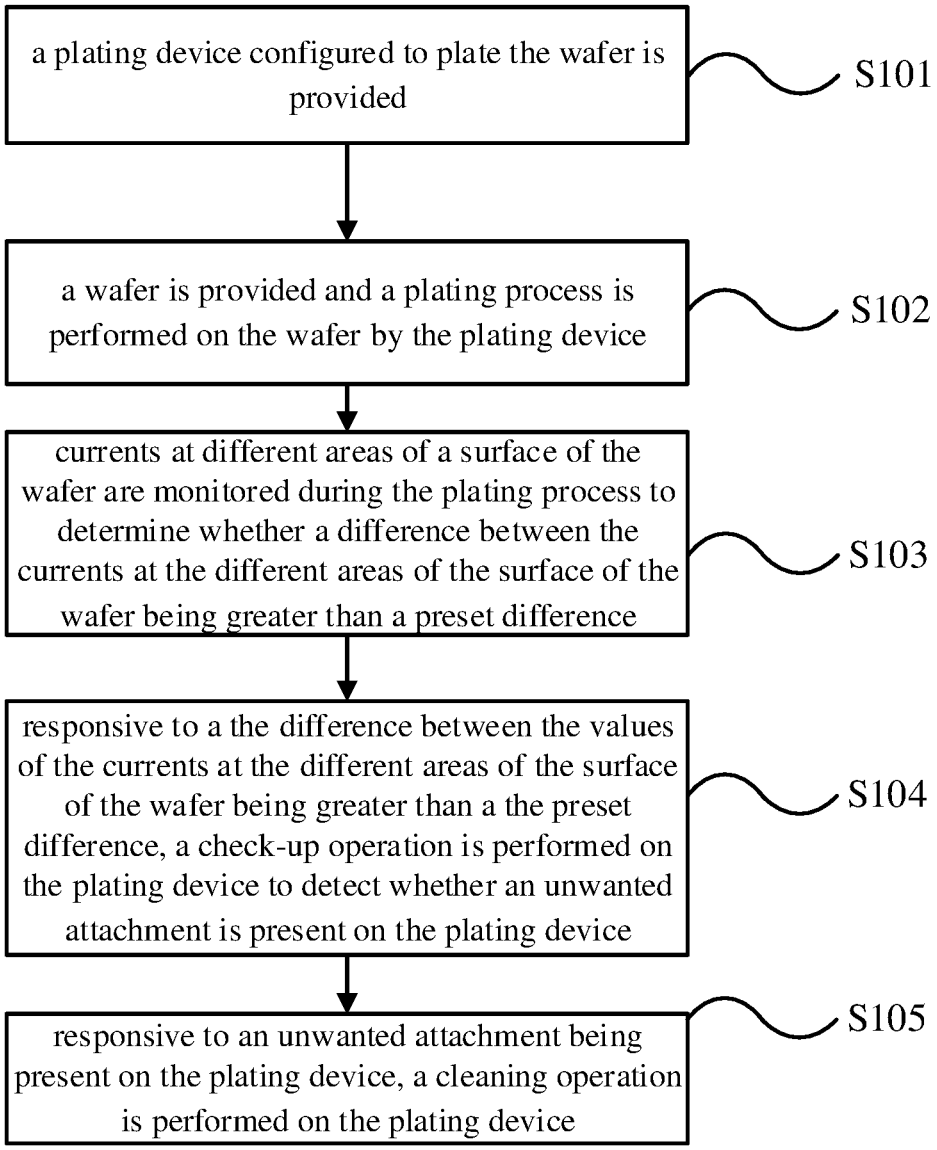
FIG. 1 is a schematic view of a method for improving uniformity of plating film on the wafer according to a first embodiment of this disclosure.

FIG. 1 is a schematic view of a method for improving uniformity of plating film on the wafer according to a first embodiment of this disclosure. The method for improving uniformity of plating film on the wafer includes the following operations.

At S101, a plating device configured to plate the wafer is provided. At S102, a wafer is provided and a plating process is performed on the wafer by the plating device. At S103, currents at different areas of a surface of the wafer are monitored during the plating process to determine whether a difference between the currents at the different areas of the surface of the wafer being greater than a preset difference. At S104, responsive to the difference between the values of the currents at the different areas of the surface of the wafer being greater than the preset difference, a check-up operation is performed on the plating device to detect whether an unwanted attachment is present on the plating device. At S105, responsive to an unwanted attachment being present on the plating device, a cleaning operation is performed on the plating device.

Figure 2:
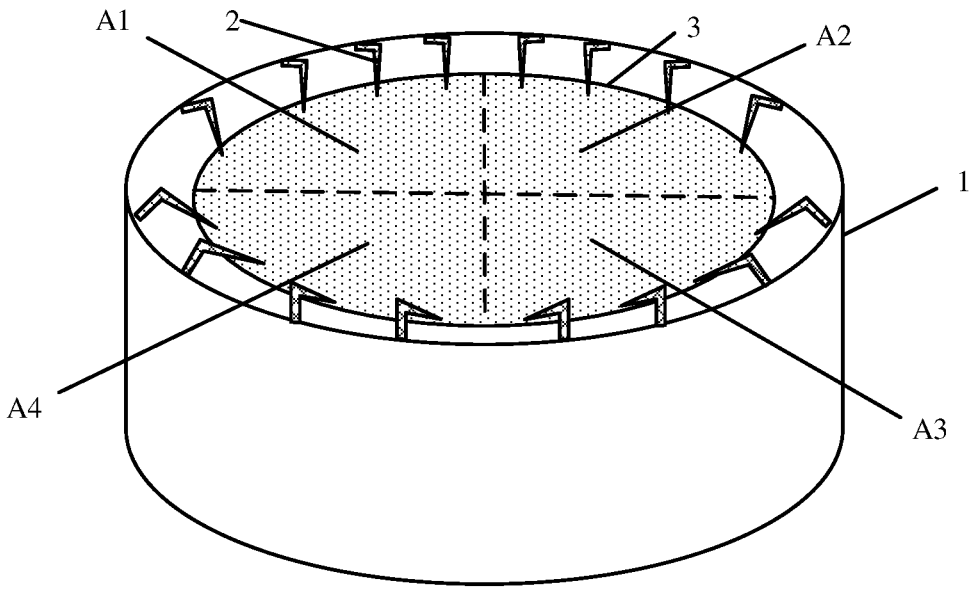
FIG. 2 is a schematic view of a plating device according to a first embodiment of this disclosure.

Still referring to FIG. 1, at S101, the plating device is provided. FIG. 2 is a schematic view of a plating device according to a first embodiment of this disclosure. Referring to FIG. 2, the plating device includes: a plating chamber 1 and a plurality of plating probes 2. An ionic solution is contained in the plating chamber 1. The current is conducted to the surface of a wafer 3 through the plating probes 2, so that metal ions in the ionic solution are reduced into metal at the upper surface of the wafer 3, thereby forming a thin and stable metal film on the upper surface of the wafer 3.

Referring to FIG. 1, at S102, a wafer is provided. The plating device is configured to plate the wafer. Referring to FIG. 2, the wafer 3 is soaked in the ionic solution, the plating probes 2 are in contact with the upper surface of the wafer 3, and the current is conducted to the surface of the wafer 3 through the plating probes 2, thereby forming a thin and solid film on the surface of the wafer 3. In this embodiment, the ionic solution is a copper sulfate solution, and the current is conducted to the surface of the wafer 3 through the plating probes 2. The copper ions in the ionic solution are reduced to copper at the upper surface of the wafer 3, thereby forming a thin and solid metal copper film on the upper surface of the wafer 3. In some embodiments, a copper rod is provided to serve as an anode for electrolysis, and the wafer serves as a cathode for electrolysis. The current causes copper of the copper rod to be ionized, that is, each copper atom becomes a positively charged copper ion by losing electrons. A reaction equation of the anode is as follow: $Cu \rightarrow Cu^{2+}+2e^{-}$. The positively charged copper ions enter into the ionic solution of the plating chamber and flow to the surface of the wafer 3. The plating probes 2 make contact with the surface of the wafer 3, so that the positively charged copper ions obtain electrons on the surface of the wafer 3 so as to be reduced into a metal state, thereby forming a thin and solid metal copper film on the surface of the wafer. A reaction equation of the cathode is as follow: $Cu^{2+}+2e^{-} \rightarrow Cu$.

Figure 3:
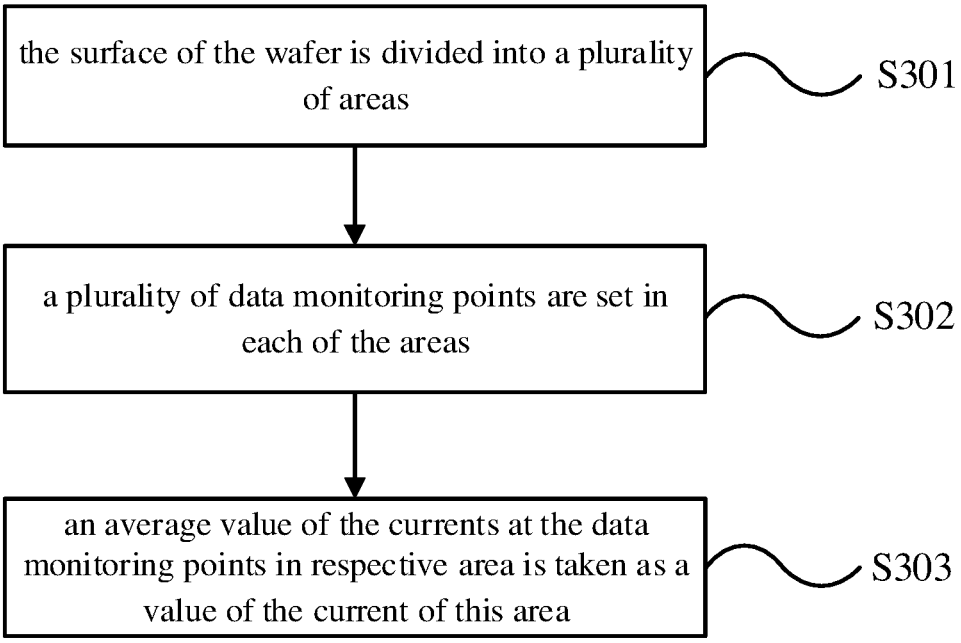
FIG. 3 is a schematic view of a method for improving uniformity of plating film on the wafer according to an embodiment of this disclosure.

Still referring to FIG. 1, at S103, currents at different areas of the surface of the wafer 3 are monitored in the plating process. FIG. 3 is a schematic view of a method for improving uniformity of plating film on the wafer according to an embodiment of this disclosure. Referring to FIG. 3, the monitoring of the currents at the different areas of the surface of the wafer includes the following operations. At S301, the surface of the wafer is divided into a plurality of areas; at S302, a plurality of data monitoring points are set in each of the areas; and at S303, an average value of the currents at the data monitoring points in respective area is taken as a value of the current of this area, to timely determine whether there is an area plated with uneven film on the surface of the wafer during the plating process.

Still referring to FIG. 2, in this embodiment, the surface of the wafer 3 is divided into different areas A1 to A4, and a plurality of data monitoring points are set in each of the areas (not shown in the drawing). The currents in the areas A1~A4 of the surface of the wafer 3 are monitored, and the average value of currents at the data monitoring points is taken as a value of the current of the area, thereby avoiding a data error caused by a single data error.

Still referring to FIG. 1, at S104, responsive to a difference between the values of the currents at the different areas of the surface of the wafer being greater than a preset difference, a check-up operation is performed on the plating device.

Still referring to FIG. 2, in this embodiment, the surface of the wafer 3 is divided into different areas A1 to A4, so as to monitor the currents at the different areas of the surface of the wafer. For example, the preset difference may be determined according to a difference between values of currents at different areas of the surface of the wafer measured when a previous wafer is plated. For example, when the previous wafer is plated, current differences between currents of areas A1 and A2, currents of A1 and A3, and currents of A1 and A4 are obtained, recorded and serve as preset current differences between the currents of surface areas A1 and A2, A1 and A3, and A1 and A4 of the present wafer 3. Similarly, current differences between currents of A2 and A3, and A2 and A4 are obtained and serve as preset current differences between currents of the surface areas A2 and A3, and A2 and A4 of the present wafer. A current difference between currents of A3 and A4 is obtained and serve as a preset current difference between currents of the surface areas A3 and A4 of the present wafer.

Responsive to detecting that the current difference between currents of any two surface areas of the wafer 3 in the present plating process is greater than the preset current difference between currents of the two surface areas, a check-up operation is performed on the plating device, that is, in this case, metal attachment may be remained on the surface of the plating device and the plating device needs to be checked. Responsive to detecting that the current difference between currents of any two surface areas of the wafer 3 in the present plating process is less than or equal to the preset current difference between the two surface areas, a next wafer is plated, that is, in this case, no metal residue attachment or little metal residue attachment (which can be ignored) is present on the surface of the plating device. It is not necessary to check the plating device. It can be understood that the next wafer is plated only when the current differences between currents of all paired surface areas are less than the preset current differences between currents of the paired surface areas, and if the current difference between currents of certain two surface areas is greater than the preset current difference between currents of said two surface areas, the plating device is checked.

Figure 4:
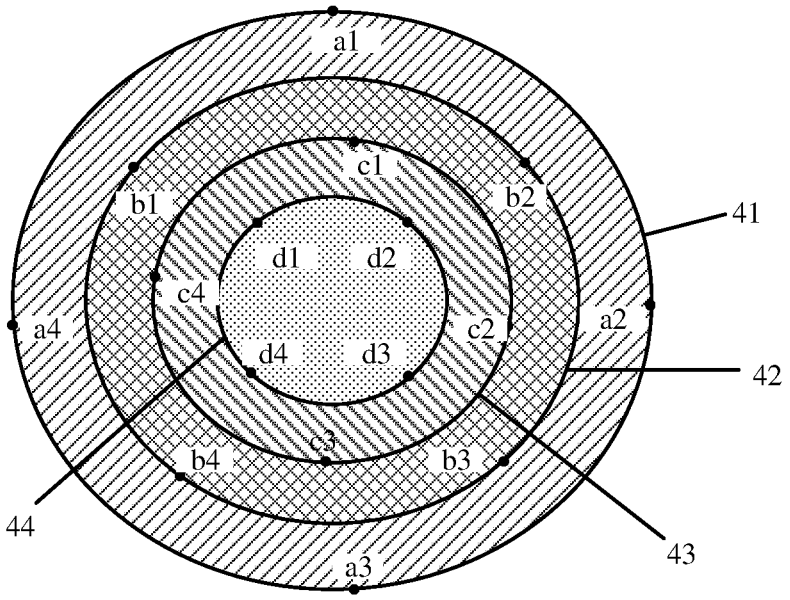
FIG. 4 is a schematic view of dividing a surface area of a wafer according to a second embodiment of this disclosure.

In first embodiment, the surface of the wafer 3 is divided into different areas A1 to A4, so as to monitor the currents at the different areas of the surface of the wafer. In other embodiments, the method for improving uniformity of plating film on the wafer further includes the following operations. A plurality of concentric current rings are provided on the plating device. Responsive to a difference between currents of two current rings being greater than a preset difference, it is determined that the difference between the currents at the different areas of the surface of the wafer is greater than the preset difference. FIG. 4 is a schematic view of dividing a surface area of a wafer according to a second embodiment of this disclosure. Referring to FIG. 4, in the second embodiment, four concentric current rings 41 to 44 are provided on the plating device. In other embodiments, another number of current rings may also be provided. A plurality of data monitoring points are set on each current ring, and an average value of the currents at the data monitoring points is taken as a value of the current of the current ring.

In this embodiment, four data monitoring points a1 to a4 are set on the current ring 41, and an average value of the currents at the data monitoring points a1 to a4 is taken as a value of the current of the current ring 41. Four data monitoring points b1 to b4 are set on the current ring 42, and an average value of currents at the data monitoring points b1 to b4 is taken as a value of the current of the current ring 42. Four data monitoring points c1 to c4 are set on the current ring 43, and an average value of the currents at the data monitoring points c1 to c4 is taken as a value of the current of the current ring 43. Four data monitoring points d1 to d4 are set on the current ring 44, and an average value of the currents at the data monitoring points d1 to d4 is taken as a value of the current of the current ring 44.

In some embodiments, the center of the plurality of concentric current rings coincides with the center of the wafer 3, and the data monitoring points on the same current ring are equidistant from the center of the wafer, so as to improve uniformity of data monitoring for the data monitoring points.

Responsive to detecting that the difference between currents of any two current rings being greater than a preset difference, it is determined that the difference between the currents at the different areas of the surface of the wafer is greater than the preset difference. The preset difference includes: the difference between the currents of the two current rings measured when a previous wafer is plated. For example, current differences of the annular areas between the current ring 41 and the current ring 42, the current ring 41 and the current ring 43, and the current ring 41 and the current ring 44 are obtained, recorded and serve as preset current differences of the annular areas between the current ring 41 and the current ring 42, the current ring 41 and the current ring 43, and the current ring 41 and the current ring 44 for the present wafer 3. Current differences of the annular areas between the current ring 42 and the current ring 43, and the current ring 42 and the current ring 44 are obtained, recorded and serve as preset current differences of the annular areas between the current ring 42 and the current ring 43, and the current ring 42 and the current ring 44 for the present wafer 3. A current difference of the annular area between the current ring 43 and the current ring 44 is obtained, recorded and serves as a preset current difference of the annular area between the current ring 43 and the current ring 44 for the present wafer 3.

Responsive to detecting that the difference between currents of any two current rings in the present plating process is greater than the preset current difference between currents of the two current rings, a check-up operation is performed on the plating device is checked, that is, in this case, metal attachment may be remained on the surface of the plating device and the plating device needs to be checked. Responsive to detecting that the difference between currents of any two current rings in the present plating process is less than the preset current difference between currents of the two current rings, a next wafer is plated, that is, in this case, no metal attachment residue or little metal attachment residue (which can be ignored) is present on the surface of the plating device. It is not necessary to check the plating device. It can be understood that only when the current differences between all paired current rings are less than the preset current differences between the paired current rings, the next wafer is plated, and if the current difference between certain two current rings is greater than the preset current difference between said two current rings, the check-up operation is performed on the plating device.

In this embodiment, through the current differences between currents of different current rings, the area plated with uneven film on the wafer can be accurately determined, and a reason for a failure of the plating device can be quickly and accurately found, thereby facilitating timely adjustment of the plating process, improving plating uniformity, and improving the yield of wafer plating.

In the second embodiment, responsive to detecting that the current difference between currents of any two current rings in the present plating process is less than the preset current difference between currents of the two current rings, a next wafer is plated, and the plating device is not checked. Due to limited process conditions and accuracy of detection, there may be a misjudgment. Therefore, in order to further improve the accuracy of monitoring, in other embodiments, the method further includes the following operations: responsive to detecting that a current of at least one of the current rings is greater than a preset standard current in the present plating process, the check-up operation is performed on the plating device. The preset standard current includes a current of the current ring measured when a surface of a previous wafer is plated. For example, if the current in the current ring 41 measured when the present wafer is plated is greater than the current in the current ring 41 measured when the surface of the previous wafer is plated, the check-up operation is performed on the plating device. When the current values of all the current rings are less than or equal to the preset standard current, the next wafer is plated.

The check-up operation of the plating device includes using a high magnification lens to check elements for plating the wafer. For example, still referring to FIG. 1, at S105, responsive to detecting that an unwanted attachment is present on the plating device, a clean operation is performed on the plating device.

Figure 5:
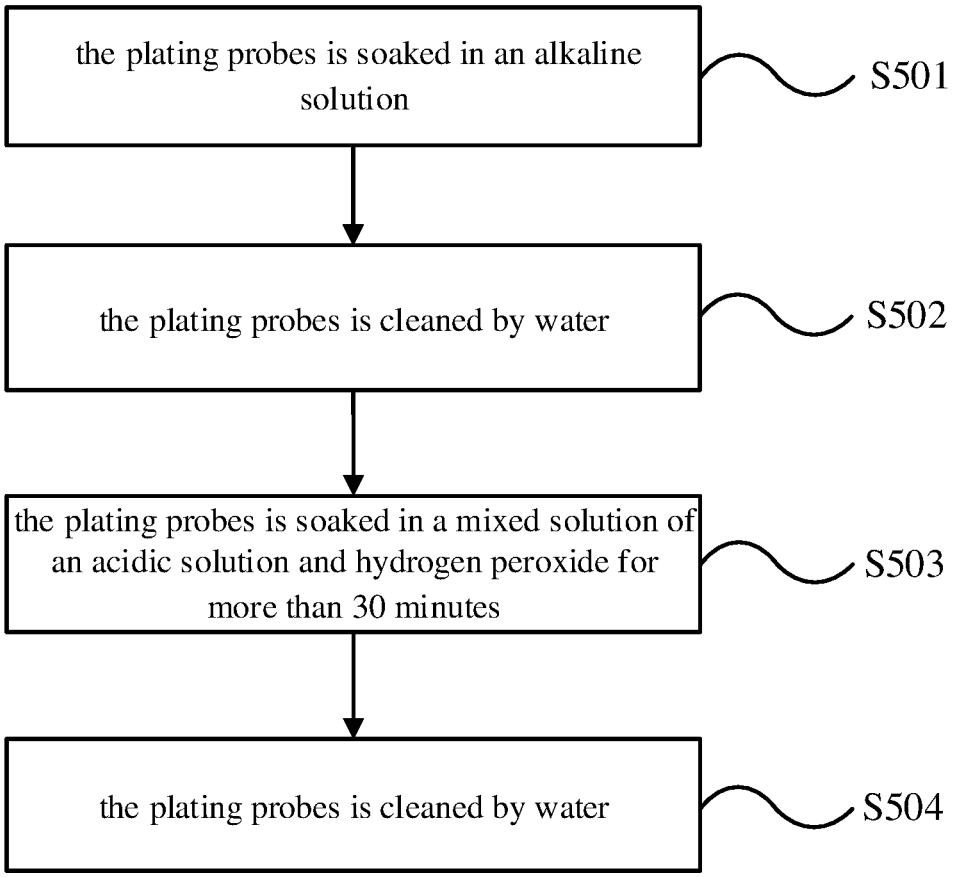
FIG. 5 is a schematic view of a method for cleaning plating probes according to an embodiment of this disclosure.

The cleaning operation of the plating device includes cleaning the plating probes. In some embodiments, the ionic solution is a copper sulfate solution. In the case that the metal copper film is formed on the surface of the wafer, the cleaning operation of the plating probes includes: cleaning copper oxide and copper attached to the plating probes. FIG. 5 is a schematic view of a method for cleaning plating probes according to an embodiment of this disclosure. The cleaning operation of the plating probes includes: at S501, the plating probes is soaked in an alkaline solution; at S502, the plating probes is cleaned by water; at S503, the plating probes is soaked in a mixed solution of an acidic solution and hydrogen peroxide for more than 30 minutes; and at S504, the plating probes is cleaned by water.

In some embodiments, the alkaline solution is ammonia water, and the acidic solution is sulfuric acid. The volume ratio of the sulfuric acid, the hydrogen peroxide, and water in a mixed solution of the acidic solution and the hydrogen peroxide is (1~2): (2~4): (5~7).

At S502, copper oxide is reduced to copper, and the reaction equation of the copper oxide and the ammonia water is: $3CuO+2NH_3=3Cu+3H_2O+N_2$. At S503, copper reacts with an acidic solution and the hydrogen peroxide in the mixed solution to generate copper sulfate, and the reaction equation of the copper and the mixed solution is: $Cu+H_2SO_4+H_2O_2=CuSO_4+2H_2O$. The concentration of the ammonia water is 10%~30%, the concentration of the sulfuric acid is 90%~99%, and the concentration of the hydrogen peroxide is 20%~40%.

The results of soaking, at a temperature of 20° C.~25° C., the plating probes in following three conditions are compared below: 1) the plating probes are soaked only by the mixed solution, 2) the plating probes are soaked only by the ammonia water, and 3) the plating probes are soaked by ammonia water and soaked by the mixed solution.

Figure 6:
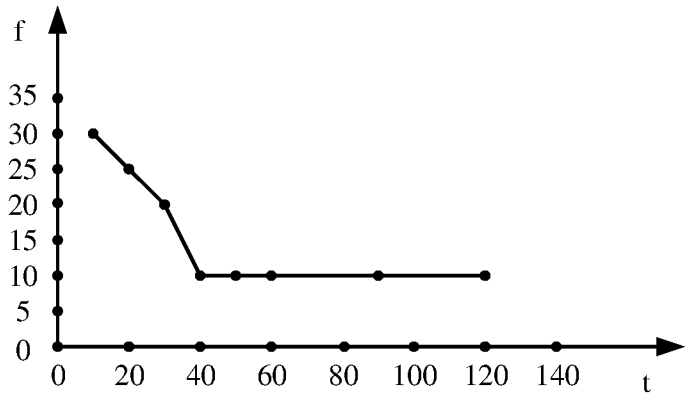
FIG. 6 is a graph showing the relationship between the soaking time and the number of times of cleaning the plating probes in the case that only a mixed solution is used according to an embodiment of this disclosure.

FIG. 6 is a graph showing the relationship between the soaking time and the number of times of cleaning the plating probes in the case that the plating probes are soaked only by a mixed solution according to an embodiment of this disclosure. The horizontal axis represents the soaking time t, and the longitudinal axis represents the number f of times that the plating probes need to be cleaned in 100 times of plating. In this embodiment, the plating probes are soaked only by the mixed solution. In the case that the soaking time is 10~40 minutes, the number of times that the plating probes need to be cleaned in every 100 times of plating is in inverse proportion to the soaking time (i.e. the number of times of cleaning will decrease as the soaking time increases). In the case that the soaking time is greater than 40 minutes, the number of times that the plating probes need to be cleaned in every 100 times of plating no longer changes along with the increase of the soaking time, and the number of times of cleaning is stabilized at 10 times.

Figure 7:
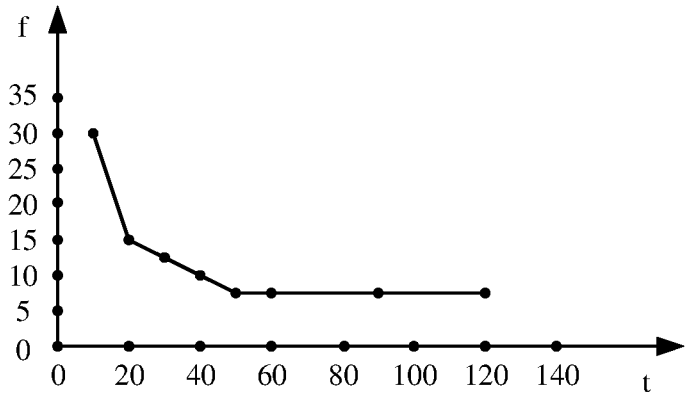
FIG. 7 is a graph showing the relationship between the soaking time and the number of times of cleaning the plating probes in the case that only ammonia water is used according to an embodiment of this disclosure.

FIG. 7 is a graph showing the relationship between the soaking time and the number of times of cleaning the plating probes in the case that the plating probes are soaked only by ammonia water according to an embodiment of this disclosure. The horizontal axis represents the soaking time t, and the longitudinal axis represents the number f of times that the plating probes need to be cleaned in 100 times of plating. In this embodiment, the plating probes are soaked only by the ammonia water. In the case that the soaking time is 10~40 minutes, the number of times that the plating probes need to be cleaned in every 100 times of plating is in inverse proportion to the soaking time (i.e. the number of times of cleaning will decrease as the soaking time increases). In the case that the soaking time is greater than 40 minutes, the number of times that the plating probes need to be cleaned in every 100 times of plating no longer change along with the increase of the soaking time, and the number of times of cleaning is stabilized at 8 times.

Figure 8:
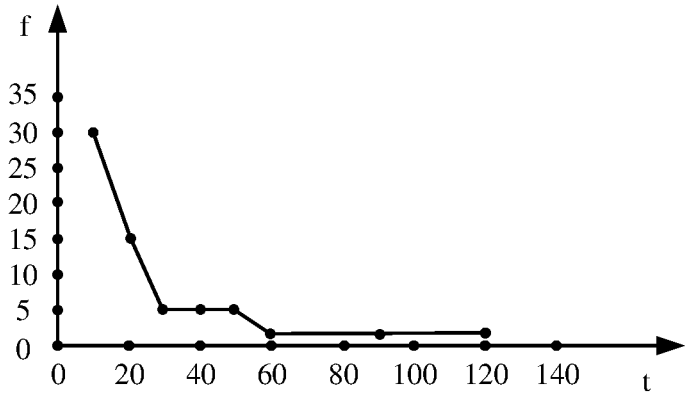
FIG. 8 is a graph showing the relationship between the soaking time and the number of times of cleaning the plating probes in the case that ammonia water and a mixed solution are successively used according to an embodiment of this disclosure.

FIG. 8 is a graph showing the relationship between the soaking time and the number of times of cleaning the plating probes in the case that the plating probes are soaked successively by ammonia water and a mixed solution according to an embodiment of this disclosure. The horizontal axis represents the soaking time t, and the longitudinal axis represents the number f of times that the plating probes need to be cleaned in 100 times of plating. In this embodiment. In this embodiment, after the plating probes are soaked in the ammonia water for 60~120 minutes, the plating probes are cleaned by water, and then the plating probes are soaked in the mixed solution. In the case that the soaking time for the mixed solution is 10~50 minutes, the number of times that the plating probes need to be cleaned in every 100 times of plating is in inverse proportion to the soaking time (i.e. the number of times of cleaning will decrease as the soaking time increases). In the case that the soaking time is greater than 50 minutes, the number of times that the plating probes need to be cleaned in every 100 times of plating no longer change along with the increase of the soaking time, and the number of times of cleaning is stabilized at 1 time.

By comparison, it can be seen that, when the plating probes are soaked by ammonia water and then by the mixed solution, the number of times that the plating probes need to be cleaned in every 100 times of plating can be reduced to 1 time, thereby reducing the number of times of cleaning the plating probes in the plating process, and improving production efficiency.

In the foregoing technical solution, the currents at the different areas of the surface of the wafer are monitored in the plating process, so that an area plated with uneven film on the surface of the wafer in the plating process can be detected timely. If the difference between the currents at the different areas of the surface of the wafer is greater than the preset difference, a check-up operation is performed on the plating device to determine the element needing to be maintained in the plating device. If an unwanted attachment is present on the plating device, the plating device is cleaned by the ammonia water and the mixed solution to remove the attachment and thus prevent it from affecting the current conducted from the plating device to the surface of the wafer, thereby improving uniformity of plating film on the wafer.

Figure 9:
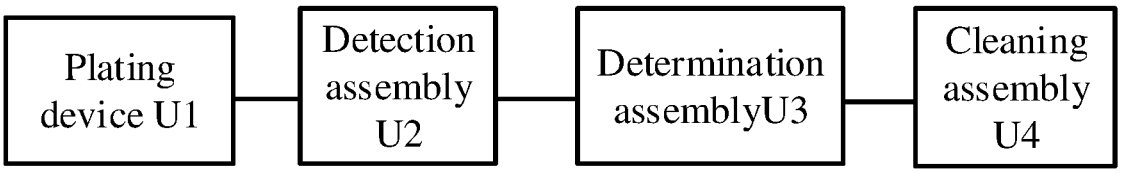
FIG. 9 is a schematic view of a system for improving uniformity of plating film on the wafer according to an embodiment of this disclosure.

FIG. 9 is a schematic view of a system for improving uniformity of plating film on the wafer according to an embodiment of this disclosure. Referring to FIG. 9, the system for improving uniformity of plating film on the wafer includes: a plating device U1; a wafer (shown in FIG. 2), the plating device being configured to coat the wafer; a detection assembly U2, configured to monitor currents at different areas of a surface of the wafer in a plating process; a determination assembly U3, configured to perform a check-up operation on the plating device responsive to a difference between the currents at the different areas of the surface of the wafer being greater than a preset difference; and a cleaning assembly U4, configured to perform a clean operation on the plating device responsive to a unwanted attachment present on the plating device.

In some embodiments, the detection assembly U2 is provided with a plurality of current detectors, which are configured to detect values of the currents at the different areas of the surface of the wafer. The current detectors are, for example, Hall sensors. The determination assembly U3 includes a current comparison circuit configured to compare the difference between the currents at the different areas of the surface of the wafer and the preset difference and determine a comparison result indicating which is larger. In some embodiments, the determination assembly U3 further includes an amplification circuit configured to amplify the currents at the different areas of the surface of the wafer, to allow the current comparison circuit to determine a slight difference between the difference between the currents at the different areas of the surface of the wafer and the preset difference. The cleaning assembly U4 includes a cleaning member. In some embodiments, the cleaning assembly U4 further includes a drying member.

FIG. 2 is a schematic view of a plating device according to a first embodiment of this disclosure. Referring to FIG. 2, the plating device U1 includes a plating chamber 1 and a plurality of plating probes 2. An ionic solution is contained in the plating chamber 1. The plating device is configured to plate the wafer. The wafer 3 is soaked in the ionic solution, and the plating probes 2 are in contact with the upper surface of the wafer 3. The current is conducted to the surface of the wafer 3 through the plating probes 2, so that metal ions in the ionic solution are reduced into metal on the upper surface of the wafer 3, thereby forming a thin and stable metal film on the upper surface of the wafer 3.

Referring to FIG. 9, the detection assembly U3 is configured to monitor the currents at the different areas of the surface of the wafer 3 in a plating process. FIG. 3 is a schematic view of a method for improving uniformity of plating film on the wafer according to an embodiment of this disclosure. Referring to FIG. 3, the monitoring of the currents at the different areas of the surface of the wafer includes the following operations. At S301, the surface of the wafer is divided into a plurality of areas; at S302, a plurality of data monitoring points are set in each of the areas; and at S303, an average value of the currents at the data monitoring points in respective area is taken as a value of the current of this area, to timely determine whether there is an area plated with uneven film on the surface of the wafer during the plating process.

Referring to FIG. 9, the determination assembly U3 is configured to perform a check-up operation on the plating device responsive to a difference between the currents at the different areas of the surface of the wafer being greater than a preset difference. Responsive to detecting that the current difference between currents of any two surface areas of the wafer 3 in the present plating process is less than or equal to the preset current difference between the two surface areas, a next wafer is plated.

Referring to FIG. 9, the cleaning assembly U4 is configured to perform a cleaning operation on the plating device responsive to detecting that an unwanted attachment is present on the plating device. The check-up operation of the plating device includes using a high magnification lens to check elements for plating. For example, still referring to FIG. 1, at S105, responsive to detecting that an unwanted attachment is present on the plating device, a clean operation is performed on the plating device.

The cleaning operation of the plating device includes cleaning the plating probes. In some embodiments, the ionic solution is a copper sulfate solution. In the case that the metal copper film is formed on the surface of the wafer, the cleaning operation of the plating probes includes: cleaning copper oxide and copper attached to the plating probes. FIG. 5 is a schematic view of a method for cleaning plating probes according to an embodiment of this disclosure. The cleaning operation of the plating probes includes: at S501, the plating probes is soaked in an alkaline solution; at S502, the plating probes is cleaned by water; at S503, the plating probes is soaked in a mixed solution of an acidic solution and hydrogen peroxide for more than 30 minutes; and at S504, the plating probes is cleaned by water.

In some embodiments, the alkaline solution is ammonia water, and the acidic solution is sulfuric acid. The volume ratio of the sulfuric acid, the hydrogen peroxide, and water in a mixed solution of the acidic solution and the hydrogen peroxide is (1~2): (2~4): (5~7).

At S502, copper oxide is reduced to copper, and the reaction equation of the copper oxide and the ammonia water is: $3CuO+2NH_3=3Cu+3H_2O+N_2$. At S503, copper reacts with an acidic solution and the hydrogen peroxide in the mixed solution to generate copper sulfate, and the reaction equation of the copper and the mixed solution is: $Cu+H_2SO_4+H_2O_2=CuSO_4+2H_2O$. The concentration of the ammonia water is 10%~30%, the concentration of the sulfuric acid is 90%~99%, and the concentration of the hydrogen peroxide is 20%~40%.

The results of soaking, at a temperature of 20° C.~25° C., the plating probes in following three conditions are compared below: 1) the plating probes are soaked only by the mixed solution, 2) the plating probes are soaked only by the ammonia water, and 3) the plating probes are soaked by ammonia water and soaked by the mixed solution.

FIG. 6 is a graph showing the relationship between the soaking time and the number of times of cleaning the plating probes in the case that the plating probes are soaked only by a mixed solution according to an embodiment of this disclosure. FIG. 7 is a graph showing the relationship between the soaking time and the number of times of cleaning the plating probes in the case that the plating probes are soaked only by ammonia water according to an embodiment of this disclosure. FIG. 8 is a graph showing the relationship between the soaking time and the number of times of cleaning the plating probes in the case that the plating probes are soaked successively by ammonia water and a mixed solution according to an embodiment of this disclosure. The horizontal axis represents the soaking time t, and the longitudinal axis represents the number f of times that the plating probes need to be cleaned in 100 times of plating.

In the case that the plating probes are soaked only by the mixed solution. If the soaking time is 10~40 minutes, the number of times that the plating probes need to be cleaned in every 100 times of plating is in inverse proportion to the soaking time (i.e. the number of times of cleaning will decrease as the soaking time increases). If the soaking time is greater than 40 minutes, the number of times that the plating probes need to be cleaned in every 100 times of plating no longer changes along with the increase of the soaking time, and the number of times of cleaning is stabilized at 10 times.

By comparison, it can be seen that, when the plating probes are soaked by ammonia water and then by the mixed solution, the number of times that the plating probes need to be cleaned in every 100 times of plating can be reduced to 1 time, thereby reducing the number of times of cleaning the plating probes in the plating process, and improving production efficiency.

In the foregoing technical solution, the plating device U1 is configured to plate the wafer 3. The detection assembly U2 is configured to monitor the currents at the different areas of the surface of the wafer, so that an area plated with uneven film on the surface of the wafer in the plating process can be detected timely. If the difference between the currents at the different areas of the surface of the wafer is greater than the preset difference, a check-up operation is performed on the plating device. The determination assembly U3 is configured to determine the element needing to be maintained in the plating device. If an unwanted attachment is present on the plating device, the cleaning assembly U4 is configured to clean the plating device by the ammonia water and the mixed solution to remove the attachment and thus prevent it from affecting the current conducted from the plating device to the surface of the wafer, thereby improving uniformity of plating film on the wafer.

The descriptions above are merely preferred embodiments of this disclosure. It should be noted that many modifications and variations can be made thereto for persons skilled in the art without departing from the principle of this disclosure, and those modifications and variations should also be regarded as falling within the scope of protection of this disclosure.

The invention claimed is:

1. A method for improving uniformity of plating film on a wafer, comprising:

providing a plating device configured to plate a wafer;

providing the wafer and performing a plating process on the wafer by the plating device;

monitoring currents at different areas of a surface of the wafer in a plating process to determine whether a difference between the currents at the different areas of the surface of the wafer is greater than a preset difference;

responsive to the difference between the currents at the different areas of the surface of the wafer being greater than the preset difference, performing a check-up operation on the plating device to detect whether an unwanted attachment is present on the plating device; and responsive to detecting that the unwanted attachment is present on the plating device, performing a cleaning operation on the plating device.

2. The method for improving uniformity of plating film on the wafer of claim 1, wherein the monitoring the currents at the different areas of the surface of the wafer comprises:

dividing the surface of the wafer into a plurality of areas;

setting a plurality of data monitoring points in each of the areas; and taking an average value of currents at the data monitoring points as a value of the current at the respective area.

3. The method for improving uniformity of plating film on the wafer of claim 1, further comprising:

responsive to the difference between the currents at the different areas of the surface of the wafer being less than or equal to the preset difference, plating a next wafer.

4. The method for improving uniformity of plating film on the wafer of claim 1, wherein the performing a check-up operation on the plating device comprises: checking elements for plating by a high magnification lens.

5. The method for improving uniformity of plating film on the wafer of claim 1, wherein the performing a cleaning operation on the plating device comprises:

cleaning the plating probes.

6. The method for improving uniformity of plating film on the wafer of claim 5, wherein the cleaning the plating probes comprises:

soaking the plating probes by an alkaline solution;

cleaning the plating probes by water;

soaking the plating probes by a mixed solution of an acidic solution and hydrogen peroxide for more than 30 minutes; and cleaning the plating probes by water.

7. The method for improving uniformity of plating film on the wafer of claim 1, wherein the monitoring currents at different areas of a surface of the wafer in a plating process to determine whether a difference between the currents at the different areas of the surface of the wafer being greater than a preset difference comprises:

providing a plurality of concentric current rings on the plating device;

monitoring currents of the current rings to determine whether a difference between currents of any two of the current rings is greater than a preset difference; and responsive to the difference between currents of any two of the current rings being greater than the preset difference, determining that the difference between the currents at the different areas of the surface of the wafer is greater than the preset difference.

8. The method for improving uniformity of plating film on the wafer of claim 7, wherein the preset difference comprises: the difference between the currents of the two current rings measured when a previous wafer is plated.

9. The method for improving uniformity of plating film on the wafer of claim 7, wherein the monitoring currents of the current rings to determine whether a difference between currents of any two of the current rings is greater than a preset difference comprises: setting a plurality of data monitoring points on each current ring, and taking an average value of the currents at the data monitoring points as a value of the current of the respective current ring.

10. The method for improving uniformity of plating film on the wafer of claim 7, wherein responsive to detecting that responsive to the difference between the currents at the different areas of the surface of the wafer being greater than the preset difference, performing a check-up operation on the plating device comprises: responsive to a current of at least one of the current rings being greater than a preset standard current, performing the check-up operation on the plating device.

11. The method for improving uniformity of plating film on the wafer of claim 10, wherein the preset standard current comprises a current of the current ring for the surface of the wafer measured when a previous wafer is plated.

* * * * *